United States Patent [19]

Mui et al.

[11] Patent Number: 4,697,228

[45] Date of Patent: Sep. 29, 1987

[54] COLLAPSIBLE LIGHT WAND

[76] Inventors: Paul Y. H. Mui; Rosa Y. M. Tso, both of 3218 Quintara St., San Francisco, Calif. 94116

[21] Appl. No.: 907,435

[22] Filed: Sep. 15, 1986

[51] Int. Cl.[4] ..... F21V 1/06

[52] U.S. Cl. ..... 362/352; 362/208

[58] Field of Search ..... 362/102, 109, 202, 208, 362/346, 352; 446/219, 473; 340/321

[56] References Cited

U.S. PATENT DOCUMENTS

| | | | |
|---|---|---|---|
| 2,362,131 | 11/1944 | Haggart, Jr. | 177/329 |
| 2,486,998 | 11/1949 | Szeklinski | 177/327 |
| 2,611,019 | 9/1952 | Warner | 362/208 |
| 2,647,254 | 7/1953 | Brunnhoelzl | 340/321 |
| 3,787,675 | 6/1974 | Rushing et al. | 240/10.6 SD |
| 4,104,708 | 8/1978 | Bohli | 362/34 |
| 4,208,701 | 6/1980 | Schock | 362/202 |
| 4,231,077 | 10/1980 | Joyce et al. | 362/32 |
| 4,544,990 | 10/1985 | Wieselman et al. | 362/32 |

*Primary Examiner*—Stephen F. Husar

*Attorney, Agent, or Firm*—Townsend and Townsend

[57] ABSTRACT

A collapsible light wand is formed from a telescopic tube assembly comprised of a plurality of overlapping translucent tube sections, the outermost tube section being attachable to the light end of a flashlight. A locking bar pivotally mounted to either the flashlight or to the outermost tube section may be swung over the ends of the tube sections when they are in the nested (retracted) position. A storage cylinder large enough to receive the nested tube assembly may also be provided, and is preferably attachable to the rear end of the flashlight for ease of carrying.

7 Claims, 5 Drawing Figures

COLLAPSIBLE LIGHT WAND

BACKGROUND AND SUMMARY OF THE INVENTION

This invention relates to hand-held light devices for recreational and safety uses. In particular, this invention relates to light wands such as might be used by spectators at sports events, for directing traffic on land, sea or air, for signaling help, or as children's toys such as a rainbow wand or light sword.

In accordance with the invention, the light wand is comprised of a telescopic tube assembly designed for attachment to the light bulb end of a flashlight, the assembly being extendable for use as an elongated light wand of high visibility, yet retractable when not in use for purposes of ease of storage and transportation. A pivoting bar on the device or on the flashlight to which it is attached may be swung over the front of the tube assembly once the assembly is in the retracted position, to lock the tube sections in that position. Further preferred features include a storage cylinder sized to receive the compacted tube assembly, the storage cylinder being mountable to the rear end of the flashlight. A clip on either the rear end of the flashlight or the storage cylinder permits attachment of the device to a belt, belt loop, or other article of clothing for ease of transport.

DETAILED DESCRIPTION OF THE INVENTION

Figure 1:
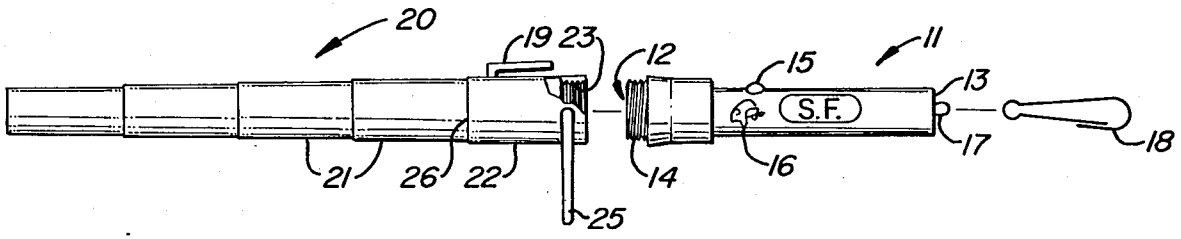
FIG. 1 is a side view of a collapsible light wand in accordance with the present invention, showing the telescopic tube assembly in the extended position.

The example shown in FIG. 1 includes a flashlight 11 having a light end 12 and a rear end 13, the light end bearing external threads. This may be a conventional flashlight with the lens removed, since in most common flashlights, the lens is mounted on a ring which is screwed onto the end of the flashlight over the bulb. Also shown on the flashlight in this drawing are a switch 15, a promotional logo 16, and a ring 17 on the rear end. A clip 18 of the type attachable to a belt, belt loop, or some other article of clothing may be linked to the ring 17. Alternatively, a belt clip 19 may be secured to the exterior of the outermost tube section 22. Either way provides a convenient way of carrying the flashlight.

A telescopic tube assembly 20 is shown for attachment to the light end 12 of the flashlight 11. Colored lenses (not shown in this drawing) may be included for insertion into the tube assembly. The tube assembly is constructed of two or more overlapping tube sections 21, which are generally cylindrical in shape although slightly tapered to prevent separation when the tube assembly is expanded. The tube sections are formed of any material which transmits light and becomes visible when lit from inside. Translucent materials are preferred, particularly color-tinted materials. Fluorescent materials may also be used.

The outermost tube section 22 is designed to be mountable to the light end 12 of the flashlight 11. This may be achieved in any conventional manner, while permitting separation when desired for purposes of storage, transport, or replacement of parts in the flashlight such as the light bulb. In the embodiment shown in FIG. 1, the mounting is achieved by threaded portions, i.e., internal threads 23 in the outermost section mating with the external threads 14 on the flashlight.

A pivoting bar or loop 25 is mounted to the exterior of the outermost tube section. When the tube assembly is retracted such that the tube sections are fully nested inside one another, the pivoting bar 25 may be swung over the end 26 of the outermost tube section and thereby held in place, again for purposes of storage, transport and handling.

Figure 2:
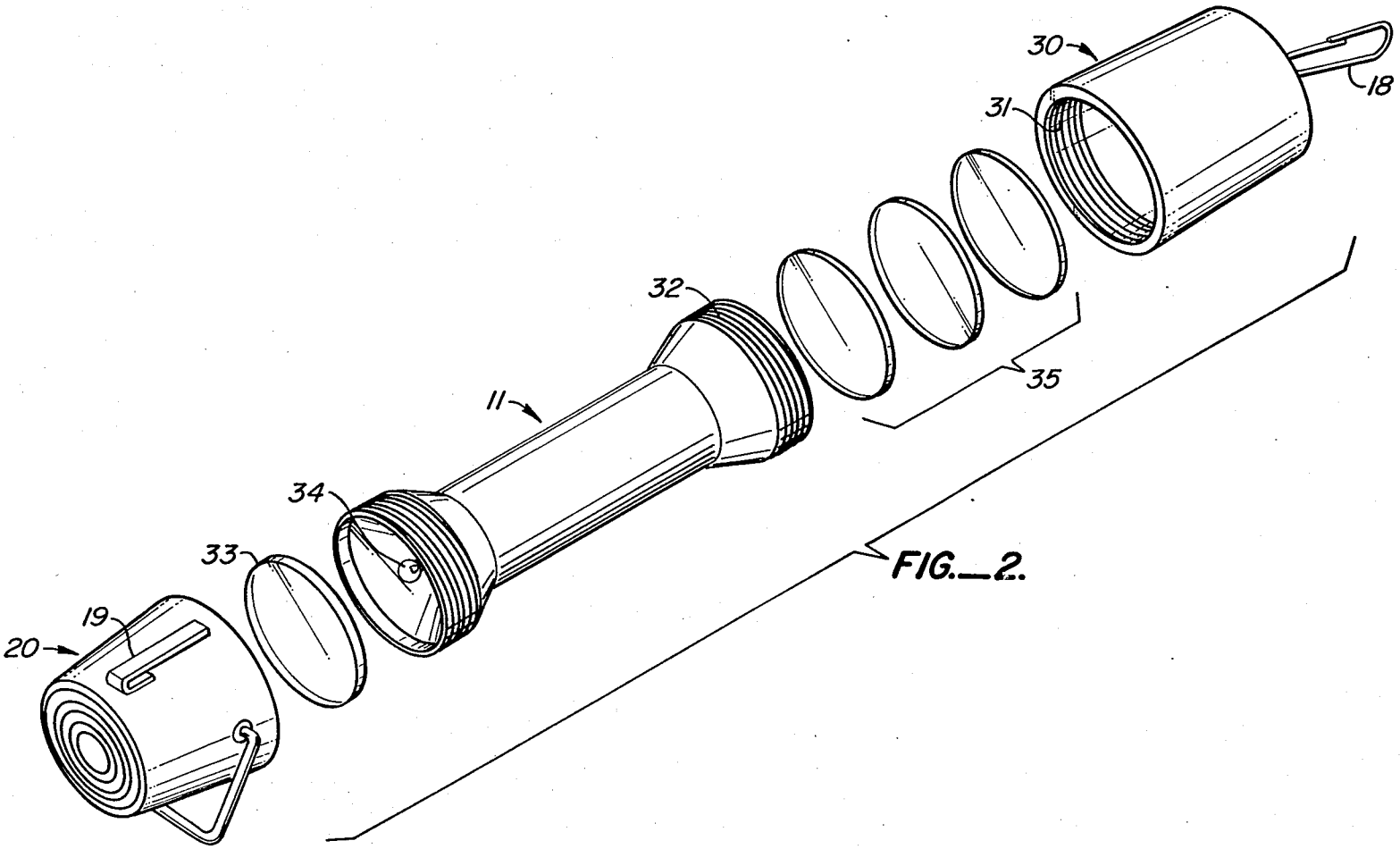
FIG. 2 is a perspective view of a further collapsible light wand in accordance with the present invention, showing the tube assembly in retracted position, and further containing a storage cylinder at the rear for holding the tube assembly and spare lenses when not in use.

Turning now to FIG. 2, a similar arrangement of flashlight 11 and telescopic tube assembly 20 is shown, except that the tube assembly is shown in the fully retracted or nested position. The embodiment in this drawing further shows a storage cylinder 30 large enough to receive the entire tube assembly 20 when the tube sections of the latter are fully nested as shown. The storage cylinder may be secured to the rear end of the flashlight 11 by mating threads on its interior wall 31 and on the exterior 32 of the rear end of the flashlight. The belt clip 18 in this embodiment is attached to the rear end of the storage cylinder 30 and the alternate belt clip 19 is attached to the exterior of the tube assembly 20 as before.

An optional colored lens 33 is shown for insertion between the flashlight bulb 34 and the telescopic tube assembly. Replacement lenses 35 of different colors may be stored in the storage cylinder 30.

Figure 3:
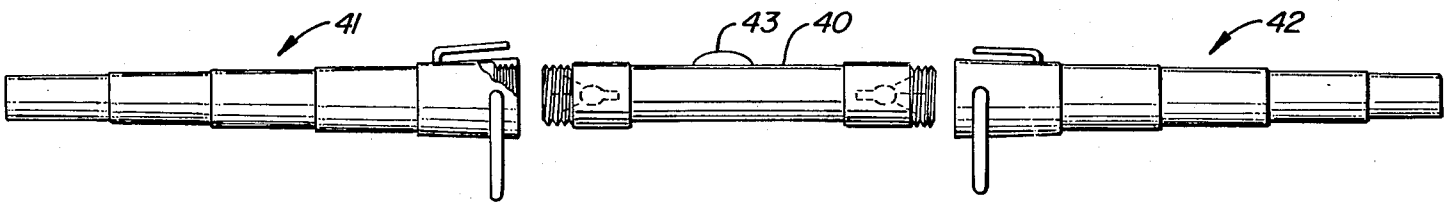
FIG. 3 is a side view of a further embodiment of the invention, in which two collapsible light wands are used, one attached to each end of a flashlight having lights at each end.

FIG. 3 depicts a two-way flashlight 40 with a bulb at each end. A pair of identical telescopic tube assemblies 41, 42 is used, one for each end of the flashlight. The switch 43 on the flashlight may be a three-position switch, including an off-position in the center and a separate on-position for each of the two bulbs. The two tube assemblies may be of different colors—for example, red and green for use in traffic control.

Figure 4:
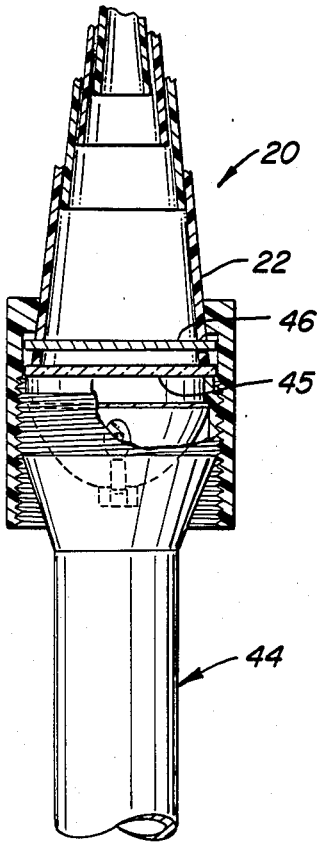
FIG. 4 is a side cutaway view of a still further embodiment of the invention, in which the light wand is secured to a standing vertical flashlight as might be used at an outside market stand.
Figure 5:
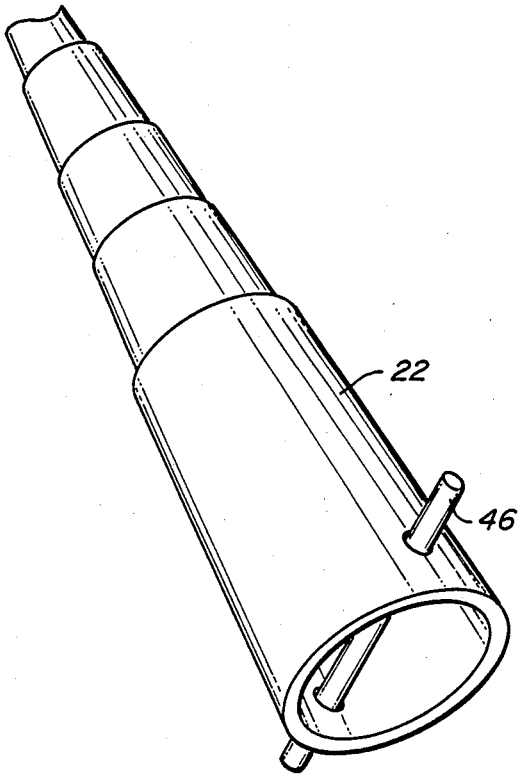
FIG. 5 is a perspective view of the telescopic tube sections of the light wand, with an optional attachment for retaining the tubes.

FIG. 4 shows the tube assembly 20 affixed to the top of a vertical light stand 44, such as might be used at an outside market. To prevent the tube sections from collapsing on their own and breaking the lens 45 in the light stand, a bar 46 is inserted in the base of the outermost tube section 22. This is more clearly shown in FIG. 5, where it can be seen that the bar passes through the tube section transversely to the tube axis.

Devices according to the present invention may be used for a variety of purposes. For example, such a device may be used as a bleacher baton in a sports event. Spectators may use such batons to express enthusiasm while cheering the players or to express disagreement with a referee's decision or to supplement a booing response. Two or more telescopic tube assemblies of different colors may be supplied with a single flashlight so that the user can change colors for different purposes such as, for instance, cheering versus booing. Once the game is over, the telescopic tube assembly may be removed entirely and the flashlight used by itself as a safety light for leaving the stadium or spectator area.

Devices constructed in accordance with the invention may also be used for traffic control on land, sea and air, either vehicular or personal. Other uses will be readily envisioned by those skilled in the art.

The foregoing description is offered primarily for purposes of illustration. It will be apparent to those skilled in the art that numerous variations and modifications of the structural elements disclosed herein may be made without departing from the spirit and scope of the invention.

What is claimed is:

1. A collapsible light wand for attachment to a flashlight comprising:

a telescopic tube assembly comprised of a plurality of overlapping translucent cylindrical tube sections, the outermost such tube section being removably mountable to the light source end of said flashlight; and a bar pivotally mounted to said outermost tube section to retain said tube assembly when retracted.

2. A collapsible light wand in accordance with claim 1 in which said removable mountability is achieved by internal threads on said outermost tube section mated with threads on the exterior of said flashlight at the light source end thereof.

3. A collapsible light wand comprising:

a flashlight having a light source end and a rear end opposing said light source end;

a telescopic tube assembly comprised of a plurality of overlapping translucent cylindrical tube sections, the outermost such tube section mountable to said light source end of said flashlight; and a bar pivotally mounted to said flashlight to retain said tube assembly when retracted.

4. A collapsible light wand in accordance with claim 3 further comprising a clip on said rear end of said flashlight for attachment to a belt worn by a user of said wand.

5. A collapsible light wand in accordance with claim 3 further comprising a storage cylinder sized to receive said tube assembly when retracted, said storage cylinder removably mountable to said rear end of said flashlight.

6. A collapsible light wand in accordance with claim 3 in which said mountability of said outermost tube section to said light source end of said flashlight is achieved by mated threads on said outermost tube section and said light source end.

7. A collapsible light wand in accordance with claim 5 further comprising a clip on said storage cylinder for attachment to a belt worn by a user of said light wand.

* * * * *